United States Patent [19]

Girault

[11] Patent Number: 4,957,411

[45] Date of Patent: Sep. 18, 1990

[54] TURBOJET ENGINE WITH FAN ROTOR BLADES HAVING TIP CLEARANCE

[75] Inventor: Patrick L. E. Girault, Boissise-le-Roi, France

[73] Assignee: Societe Nationale d'Etude et de Construction de Moteurs d'Aviaton S.N.E.C.M.A.

[21] Appl. No.: 192,528

[22] Filed: May 11, 1988

[30] Foreign Application Priority Data

May 13, 1987 [FR] France ..... 87 06671

[51] Int. Cl.[5] ..... F01D 5/20

[52] U.S. Cl. ..... 415/173.4; 416/228

[58] Field of Search ..... 415/172 A, 174; 416/228 R, 228 A, 223 R, 237

[56] References Cited

U.S. PATENT DOCUMENTS

| | | | |
|---|---|---|---|
| 2,459,850 | 1/1949 | Stine | 416/228 |
| 3,053,694 | 9/1962 | Daunt et al. | 415/174 X |
| 3,871,791 | 3/1975 | Guy et al. | 416/233 A |
| 4,274,806 | 6/1981 | Gallardo, Jr. | 415/172 A |
| 4,478,552 | 10/1984 | Thompson | 415/174 |
| 4,566,700 | 1/1986 | Shiembob | 415/174 X |
| 4,621,979 | 11/1986 | Zipps et al. | 416/223 A X |

FOREIGN PATENT DOCUMENTS

| | | | |
|---|---|---|---|
| 560589 | 9/1932 | Fed. Rep. of Germany . | |
| 349641 | 6/1905 | France . | |
| 2459363 | 1/1981 | France . | |
| 55-66602 | 5/1980 | Japan | 415/172 A |

*Primary Examiner*—Robert E. Garrett
*Assistant Examiner*—Joseph M. Pitko

[57] ABSTRACT

In a turbojet engine of the kind having a fan, the face of the radially outer tip of each rotor blade of the fan has a radiussed profile centered at a point R situated in a position displaced on the concavely curved side of the blade relative to its radial axis and beyond the rotational axis of the engine relative to the blade.

2 Claims, 3 Drawing Sheets

TURBOJET ENGINE WITH FAN ROTOR BLADES HAVING TIP CLEARANCE

BACKGROUND OF THE INVENTION

1. Field of the Invention

The invention relates to the rotor blades of the fan of a turbojet engine.

2. Description of the Prior Art

Modern turbojet engines of the bypass type usually have a compressor assembly, which is termed a fan, comprising at least one stage of rotor blades at the outlet of which the compressed air is divided into two flows: a primary flow which enters the subsequent compression stages before passing into a combustion chamber to generate a hot gas flow, and a secondary flow which enters an annular duct, termed the by-pass duct, and which, in the absence of any heating, particularly in civil turbojet engines, constitutes a cold flow . The fan thus incorporated is termed a ducted fan. The aerodynamic efficiencies of the fan are directly related to the sealing achieved between the tips of the rotor blades and the corresponding fixed inner wall of the fan casing. In order to avoid any damage having serious consequences as a result of accidental contact between the tip of a rotor blade and the associated fixed wall, which may occur due to various causes which may also be accidental (ingestions, for example) or originate from other structural or functional factors (aging, expansion, deformation, for example), the inner wall of the casing facing the blade tips usually has a wear and seal lining, termed abradable.

The invention is concerned with improving the results which have been observed during such contacts between a fan blade tip and the abradable lining of the associated casing. Indeed, one solution previously adopted with a view to ensuring a seal between blade tip and casing, while endeavouring to obtain acceptable operation during frictional contacts, consists of machining at the end of the aerofoil portion of the blade a thin tongue over the entire width of the blade profile, the tongue being intended to ensure good penetration into the abradable lining. FIGS. 1*a*, 1*b* and 1*c* of the attached drawings show an example of this known construction. The tongue 1 of the aerofoil portion 2 of a blade 3 faces the abradable lining 4 of a casing 5. However, it has been observed in this construction that as a result of the contacts between the tongue 1 and the abradable lining 4 the wear of the lining 4 exhibits irregularities, grooves and scorch marks, which seem due to the fact that chattering and bottoming phenomena occur during these contacts.

French patent specification No. A 2 459 363 also addresses certain problems met with during the rubbing of the blade tips against the wall of the casing, and more precisely seeks to achieve axial stabilization of the blades through a preferential orientation of the resultant force developed during contact. At the blade tip, a serrated profile associated with a particular geometry is obtained by means of recesses made on the concavely curved face of the blade.

However, this solution does not solve satisfactorily the problem mentioned earlier and requires, in addition, the making of a complex profile, which the invention seeks to avoid in providing a simple and better solution than is hitherto known.

SUMMARY OF THE INVENTION

According to the invention there is provided a turbo-Jet engine of the kind having a fan, said fan including an array of fan rotor blades, wherein each of said blades is mounted in said fan with a radial axis and has a radially outer tip and a concavely curved side, said radially outer tip having a face with a radiussed profile having its radius of curvature centered at a point situated, on the one hand, forward of said radial axis of said blade, i.e., in a position offset on said concavely curved side of said blade relative to said radial axis, and, on the other hand, beyond the rotational axis of said engine relative to said blade.

Preferably, the edge of said profiled radially outer tip of each blade on said concavely curved side thereof forms a cutting edge capable of entering an abradable lining on the inner wall of the fan casing facing said radially outer tips of said fan rotor blades, and said face of said radially outer tip of each blade has, as a result of its radiussed profile, a clearance angle of from four to five degrees.

BRIEF DESCRIPTION OF THE DRAWINGS

Various other objects, features and attendant advantages of the present invention will be more fully appreciated as the same becomes better understood from the following detailed description when considered in connection with the accompanying drawings in which like references characters designate like or corresponding parts throughout the several views and wherein.

DESCRIPTION OF THE PREFERRED EMBODIMENT

Figure 1A:
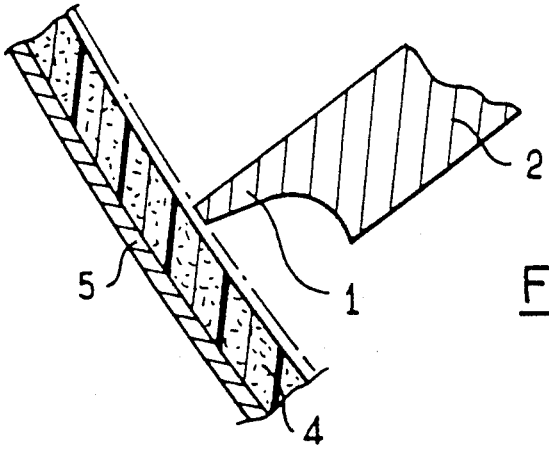
FIG. 1a PRIOR ART
FIGS. 1*a*, 1*b* and 1*c*, as described earlier, show a known form of construction for the tip of a fan blade facing a fan casing, FIG. 1*a* showing a fragmentary sectional view of the blade tip along line I—I of FIG. 1*c* together with a corresponding section of the casing, FIG. 1*b* showing an end view of the blade looking towards the radially outer tip thereof, and FIG. 1*c* showing a partial elevational view of the blade tip looking in the direction of the arrow F in FIG. 1*b;*
Figure 1B:
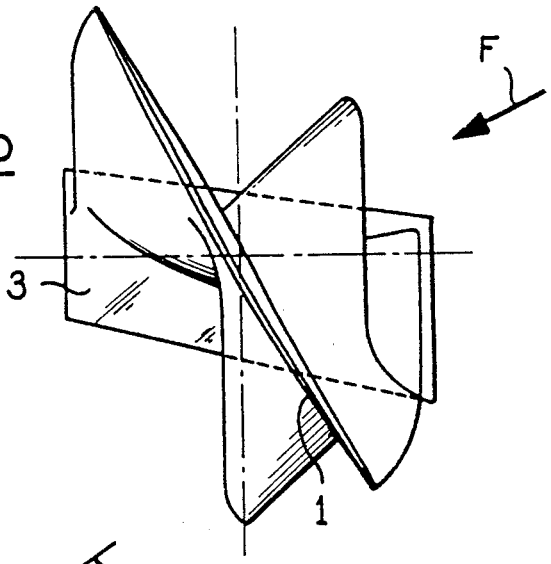
FIG. 1b PRIOR ART
Figure 1C:
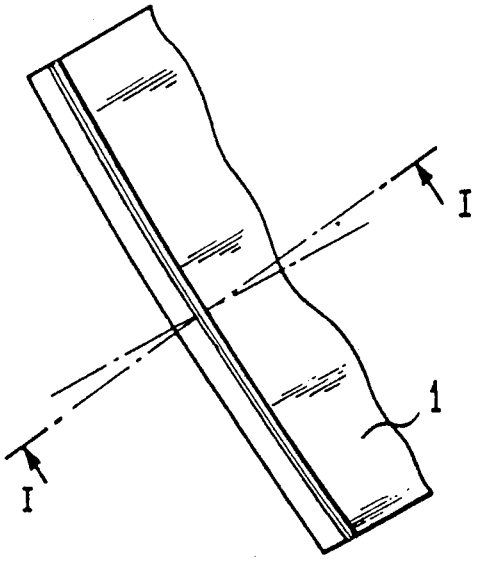
FIG. 1c PRIOR ART
Figure 2A:
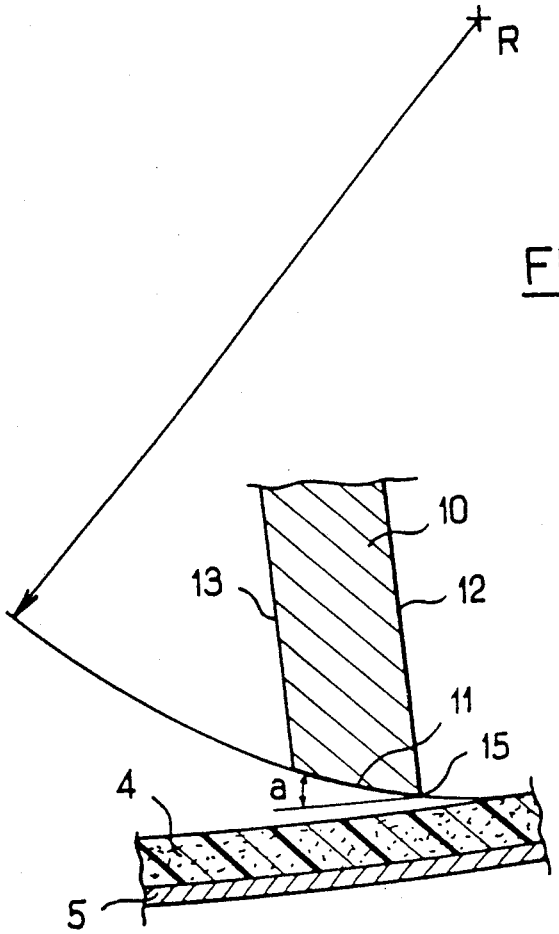
FIGS. 2*a*, 2*b* and 2*c* are views similar to those of FIGS. 1*a*, 1*b* and 1*c* but showing an embodiment of a fan blade in accordance with the invention.
Figure 2B:
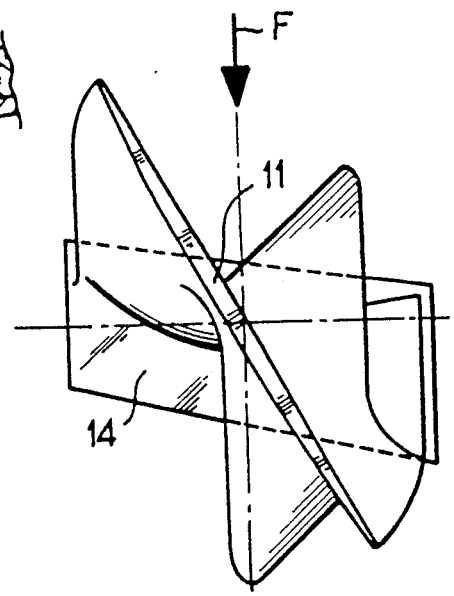
Figure 2C:
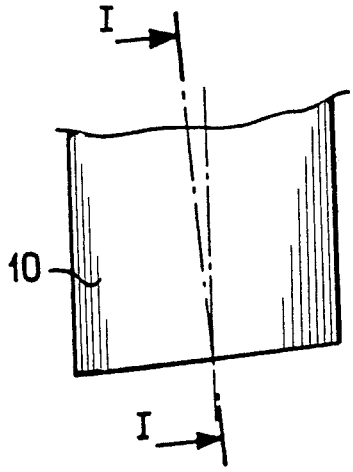
Figure 3:
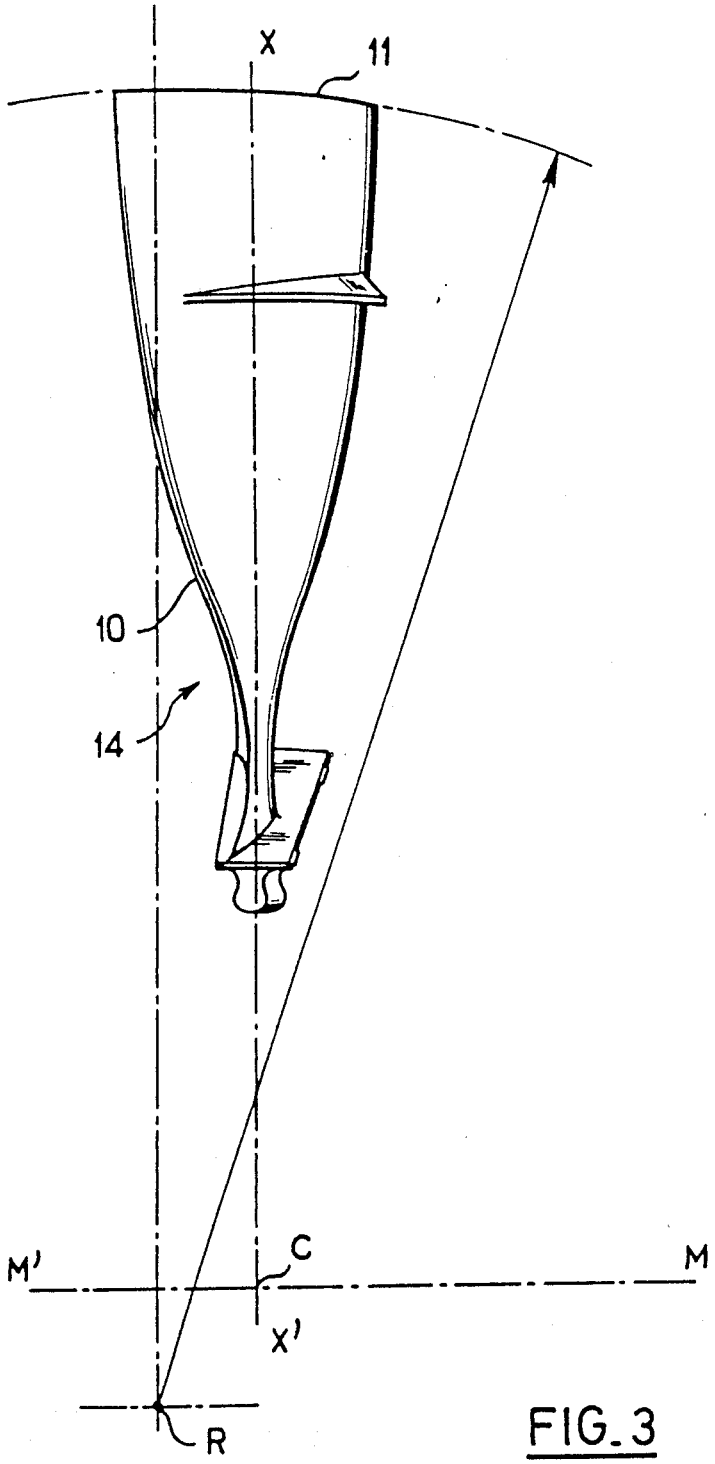
FIG. 3 shows an elevational view of the blade of FIGS. 2*a*, 2*b* and 2*c* in the position it would occupy in the fan.

In FIG. 2*a*, as in the case of FIG. 1*a* described earlier, 4 denotes the abradable lining of the inner wall of a casing 5 of a turbojet fan. FIG. 2*a* also shows the radially outer part of the aerofoil portion 10 of a rotor blade of the fan, 11 indicating the tip, 12 indicating the concavely curved side of the blade, and 13 indicating the convexly curved side of the blade. The entire blade 14 is shown in FIG. 2*b*, and FIG. 2*c* shows a partial view of the radially outer portion looking in the direction of arrow F in FIG. 2*b*. The tip 11 of the aerofoil portion 10 of the blade 14 forms with the concavely curved face 12 an edge 15. In a sectional plane such as that of FIG. 2*a*, the tip profile 11 of the blade 14 forms an angle of from four to five degrees with a line through the edge 15 and lying parallel to the wall of the casing 5. This clearance angle a is obtained by radiussing the tip 11 of the blade 14 with a centre at a point R, which may be determined as shown in FIG. 3.

If one considers the axis of rotation of the engine as M'M and the radial axis of the blade 14 in position in the fan as X'X, the point R is situated forward of the axis X'X, i.e. in a position offset on the concavely curved side 12 of the blade 14, and at the same time beyond the engine axis M'M relative to the said blade 14. Thus, whereas the inner profile of the casing is centered at point C where the engine axis M'M and the radial axis X'X of the blade intersect, the tip profile 11 of the blade 14 is radiussed about a centre at point R thus defined, separate from point C. The tip 11 of the blade 14 thus presents itself, relative to the abradable lining 4 of the casing 5 as the tip of a cutting tool having an edge situated at 15 on the concavely curved side 12 of the blade and a clearance angle a as seen in FIG. *2a*.

It follows from the arrangement described above that on contact between the tip 11 of the blade 14 and the abradable lining 4, the edge 15 enters the lining as the edge of a cutting tool and, as a result of the clearance angle a which has been adopted, the surface of the abradable lining 4 retains its initial properties.

I claim:

1. A turbojet engine of the kind having a fan, said fan including an array of fan rotor blades, wherein each of said blades is mounted in said fan with a radial axis and has a radially outer tip, a convexly curved side, and a concavely curved side, said radially outer tip having a face with a radiussed profile having its radius of curvature centered at a point situated, on the one hand, forward of said radial axis of said blade, i.e., in a position offset on said concavely curved side of said blade relative to said radial axis, and, on the other hand, beyond the rotational axis of said engine relative to said blade so that said radiussed profile from said convexly curved side to said concavely curved side of said blade forms a sharp edge on a top end portion of said concavely curved side whereby said face of said radially outer tip is adapted to enter an abradable lining of an inner wall of a casing of said fan.

2. A turbojet engine of the kind having a fan, said fan including an array of fan rotor blades, wherein each of said blades is mounted in said fan with a radial axis and has a radially outer tip, and a concavely curved side, said radially outer tip having a face with a radiussed profile having its radius of curvature centered at a point situated, on the one hand, forward of said radial axis of said blade, i.e., in a position offset on said concavely curved side of said blade relative to said signal axis, and, on the other hand, beyond the rotational axis of said engine relative to said blade wherein said engine includes a fan casing, said casing having an inner wall provided with an abradable lining which faces said radially outer tip, of each of said fan rotor blades, and wherein said radially outer tip of each blade has an edge on said concavely curved side thereof forming a cutting edge adapted for entering said abradable lining, and said face of said radially outer tip has, as a result of its radiussed profile, a clearance angle of from four to five degrees.

* * * * *